US005497888A

United States Patent [19]

Michaels et al.

[11] Patent Number: 5,497,888

[45] Date of Patent: Mar. 12, 1996

[54] MODULAR DISPLAY SYSTEM

[75] Inventors: Dean Michaels, Vermilion; Steven T. Sheiler, Kirtland; Michelle L. Fioritto, Geneva; Sharon D. Hughes, Cleveland Heights; Stephan W. Cole, Moreland Hills, all of Ohio

[73] Assignee: American Consumer Products, Inc., Solon, Ohio

[21] Appl. No.: 340,656

[22] Filed: Nov. 16, 1994

[51] Int. Cl.[6] ..... A47F 5/00

[52] U.S. Cl. ..... 211/10; 211/50; 211/189; 312/107

[58] Field of Search ..... 211/10, 11, 186, 211/189, 169, 50; 312/107, 257.1

[56] References Cited

U.S. PATENT DOCUMENTS

| | | | |
|---|---|---|---|
| 985,924 | 3/1911 | Nelson . | |
| 1,219,891 | 3/1917 | Williams | 312/107 |
| 2,104,913 | 1/1938 | Streeter | 312/107 X |
| 2,128,854 | 8/1938 | Sagendorph et al. | 211/10 X |
| 2,405,416 | 8/1946 | Foulkes | 312/107 |
| 2,506,844 | 5/1950 | Smith . | |
| 2,752,215 | 6/1956 | Peiss . | |
| 2,797,819 | 7/1957 | Lowmaster . | |
| 3,430,774 | 3/1969 | Karkut | 211/10 X |
| 3,563,624 | 2/1971 | Stice . | |
| 3,606,506 | 9/1971 | Ungaro . | |
| 3,655,065 | 4/1972 | Yellin | 312/257.1 X |
| 3,743,372 | 7/1973 | Ruggerone . | |
| 3,807,572 | 4/1974 | Luvara et al. . | |
| 3,856,147 | 12/1974 | Piretti . | |
| 3,887,076 | 6/1975 | Larsen | 211/10 |
| 3,913,289 | 10/1975 | Recker . | |
| 3,999,818 | 12/1976 | Schankler . | |
| 4,118,084 | 10/1978 | Sussman . | |
| 4,123,128 | 10/1978 | Abele . | |
| 4,247,011 | 1/1981 | Walter . | |
| 4,262,605 | 4/1981 | Sokol . | |
| 4,373,449 | 2/1983 | Klaus et al. . | |
| 4,863,222 | 9/1989 | Posso . | |
| 5,325,975 | 7/1994 | Brown et al. | 211/189 |

*Primary Examiner*—Robert W. Gibson, Jr.
*Attorney, Agent, or Firm*—Thompson Hine And Flory

[57] ABSTRACT

A modular display system for the efficient storing and displaying of a variety of substantially flat products, such as alphanumeric sign characters, includes a first display module having a width of a single length unit, an open front, a first arrangement of internal divider elements separating the internal volume of the first module of a plurality of predetermined volumes, each shaped to receive a predetermined amount of a particular product, a second display module having a width of two length units, a second internal divider arrangement separating the internal volume into a second plurality of volumes, each shaped to receive a predetermined amount of a particular product, a strip extending along the first and second modules for receiving indicia indicative of the contents of each of the first and second volumes and a connector for interconnecting a first and second module such that a plurality of first and second modules can be attached to each other and arranged in a plurality of configurations to form displaying units of different sizes, shapes and footprints to fit a variety of product mixes and spaces. Also in the preferred embodiment, modules are provided having a width of four units and dividers having a sawtooth shape which receive product and store display it in shingled fashion. Preferably, the modules include hinged panels to display representative product, and vertical dividers to support incicia which indicate particular product in the discrete volumes formed by the dividers.

10 Claims, 10 Drawing Sheets

MODULAR DISPLAY SYSTEM

BACKGROUND OF THE INVENTION

The present invention relates to storage devices, and more particularly, to modular devices for storing and displaying merchandise in retail establishments.

Consumer products which are related, yet come in a variety of sizes and shapes, such as signage, are often difficult to store efficiently and display. Since such items individually are not costly, it is necessary to develop a mechanism for the space efficient storage and display of such items in which the volume in which such items are stored and displayed is optimized for a particular combination of such items.

Attempts have been made to store and display such a variety of products, but in stores and other retail establishments there are virtually an infinite variety of height and width requirements which vary from store to store, and possibly within stores as well. Accordingly, presently it is necessary to design a storage and display unit which is configurable to meet the space and product assortment needs specific to a particular retail establishment.

Accordingly, there is a need for a configurable system for the efficient storage and display of products of assorted types and sizes which can be assembled, configured and reconfigured.

SUMMARY OF THE INVENTION

The present invention is a modular system for the storage and display of a variety of substantially flat products which consists of at least two display modules of different modular sizes. Each display module is subdivided into a plurality of internal volumes, each shaped to store a plurality of individual product pieces. The first and second modules are modular in dimension; that is, the second module has a width which is twice the width of the first module so that a selected number of first and second modules can be configured into an integral unit having a predetermined vertical frontal area and overall width.

In the preferred embodiment, the modular display system is shaped not only to store, but to display signage, such as individual letters and numbers for house signs, boat signs and the like. The modules of the preferred embodiment are provided with a variety of internal dividers, so that modules can be combined to accommodate a variety of alphanumeric sizes and shapes, as well as three-dimensional alphanumeric elements. The internal dividers are shaped so that individual units of product can be mounted thereon and thereby indicate the particular type of product stored in a module. In a preferred embodiment, panels are attached to the modules by hinges, and support representative product types. Such panels are especially useful for product samples which are too large to mount on the dividers. The panels can be pivoted away from the modules to provide access to the product stored in the modules.

Also in the preferred embodiment, a third module is provided which has a modular width of four length units and includes horizontally extending dividers having sawed-tooth shaped upper surfaces. Such an upper surface is sized to receive stacks of large, flat objects, such as FOR SALE signs and the like, in shingled fashion.

A fourth module is also included in the preferred embodiment and is divided to provide display space for products which are suspended in horizontal stacks from rods attached to a rear wall of that module. Accordingly, in the preferred embodiment of the invention, a number of modules of different shapes and widths is provided. This array enables a display unit to be assembled which can fit a variety of vertical and horizontal space requirements. Further, the individual modules can be configured to include internal dividers which are shaped to receive particular product shapes to allow for a variety of product assortments.

Accordingly, it is an object of the present invention to provide a modular display system which made up a plurality of display modules of differing widths so that the modules can be attached to each other in a variety of configurations; a modular display system which is capable of both storing and displaying a wide variety of products which have varying shapes yet are related; a modular display system which is relatively inexpensive to fabricate and is relatively easy to assemble; and a modular display system which is versatile, yet is capable of storing efficiently and displaying aesthetically a wide variety of articles.

Other objects and advantages will be apparent from the following description, the accompanying drawings and appended claims.

DETAILED DESCRIPTION

Figure 1:
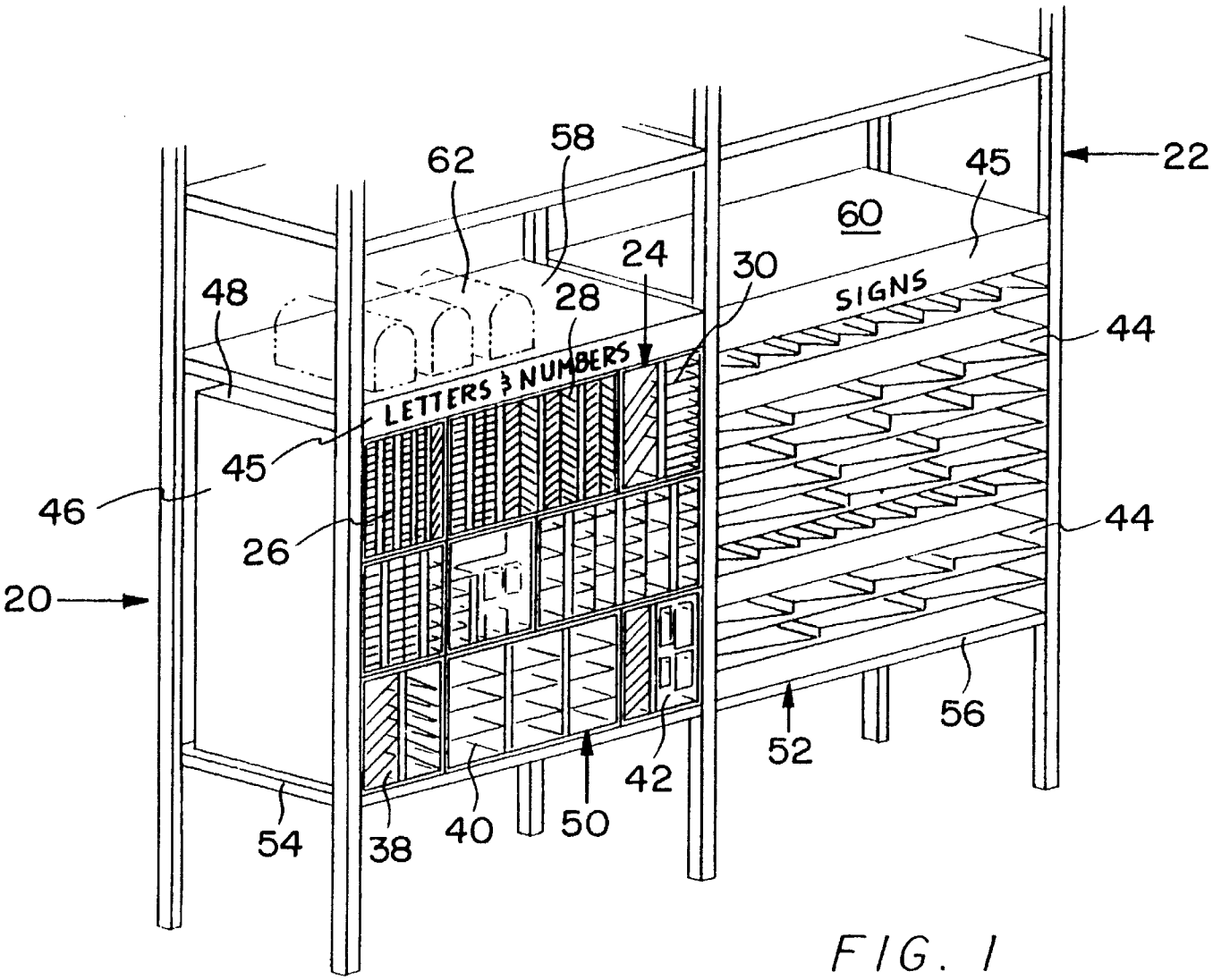
FIG. 1 is a schematic, perspective view of a preferred embodiment of the modular display system of the present invention.
Figure 2:
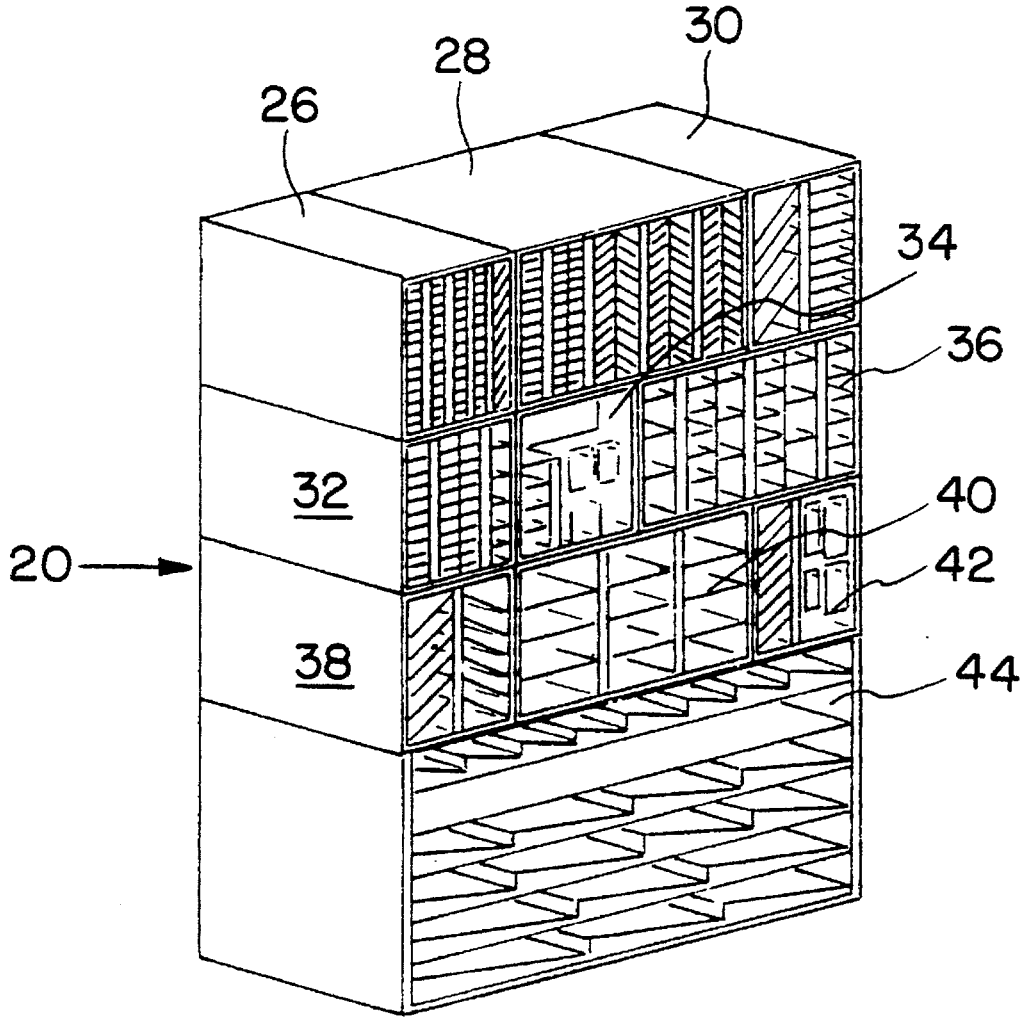
FIG. 2 is a schematic, perspective view of the modular display system of the present invention, in which the individual modules are reconfigured from the unit shown in FIG. 1.

As shown in FIGS. 1 and 2, the modular display system of the present invention, generally designated 20, is designed to be incorporated into a retail store, such as hardware store shelving, shown generally designated 22, if desired. The system 20 comprises a plurality of open-faced modules, generally designated 24, of a variety of widths and heights. As shown in FIG. 2, the configuration of the system 20 includes a top row having display modules 26, 28, 30; a second row comprising modules 32, 34, 36; a third row comprising modules 38, 40, 42 and a fourth row comprising module 44. The system of FIG. 1 also includes a top row, second row and third row, as well as two modules 44 forming a second stack of modules. Product signs 45 are attached to the tops of the modules, and indicate generally the contents of the modules.

It should be noted that modules 26, 30, 32, 34, 38, and 42 are each one unit length wide, such as 12 inches. Modules 28, 36 and 40 each have a width of two unit lengths, which would equal 24 inches in the preferred embodiment. Module 44 has a width of four unit lengths or 48 inches. It is within the scope of the invention to provide unit widths of a different value; however, the advantage of the invention lies in the use of modules 24 which are whole number integer multiples of the width of the narrowest module. That way, different modules 24 can be arranged in a variety of combinations to form a generally rectangular unit 20.

The depths of all of the modules 24 are the same so that when the modules are arranged as in FIGS. 1 and 2, a cube is formed of uniform depth. Also as shown in FIG. 1, side trim panels 46 (the left panel being shown in FIG. 1 and the right panel not being shown) and top trim panel 48 are used to provide a pleasing visual effect when the display system 20 stands alone and its sides and top are exposed to customers. As shown in FIG. 1, the system 20 includes two units 50, 52 placed side by side on shelving 22 and supported on bottom shelves 54, 56 of the shelving unit 22. The shelving unit includes upper shelves 58, 60 which are shaped to receive related articles. In the example shown, the display system 20 is used to store and display alphanumeric characters for use in making house signs. Accordingly, shelves 58, 60 would be used to support related articles such as mailboxes 62.

Figure 3:
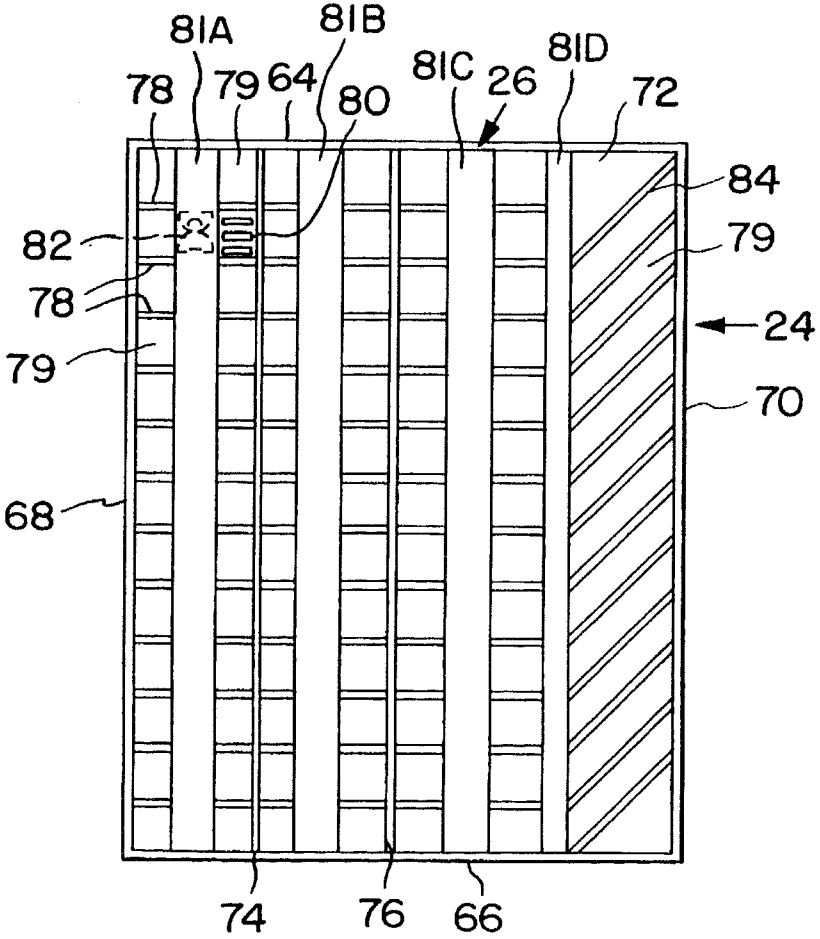
FIG. 3 is a side elevation of a single unit width module of the modular display system of FIGS. 1 and 2.

As shown in FIG. 3, module 26 includes top and bottom walls 64, 66, opposing, vertically extending side walls 68, 70 and a rear wall 72. Module 26 includes vertical dividers 74, 76 and horizontal dividers 78, which together divide the interior volume of the module into a plurality of individual compartments 79 for the storage of stacks 80 of product. Module 26 also includes vertical panels 81A, 81B, 81C, 81D which are sized to receive indicia, such as representative product, such as alphanumeric characters 82, which indicate the type of product stored in each individual internal volume 79 of the module. In the embodiment shown, an assortment of the appropriate alphanumeric characters (e.g., A–Z and 0–9) of a certain size and style would be stored so that each volume 79 would hold a a flat stack of a distinct alphanumeric character and would be labeled with an appropriate label 82 on panel 81. On the right hand portion of module 26, panel 81 is separated from wall 70 by a plurality of inclined dividers 84, which store a wider product in a stacked vertical column which is somewhat shingled. In the embodiment shown, the actual width of the volumes defined by dividers 84 between vertical side wall 70 and adjacent panel 81D is substantially equal to the width of the volumes 79 between central panels 81B, 81C, so that the internal dividers are modular, yet can accommodate stacks of product of different widths.

Figure 4:
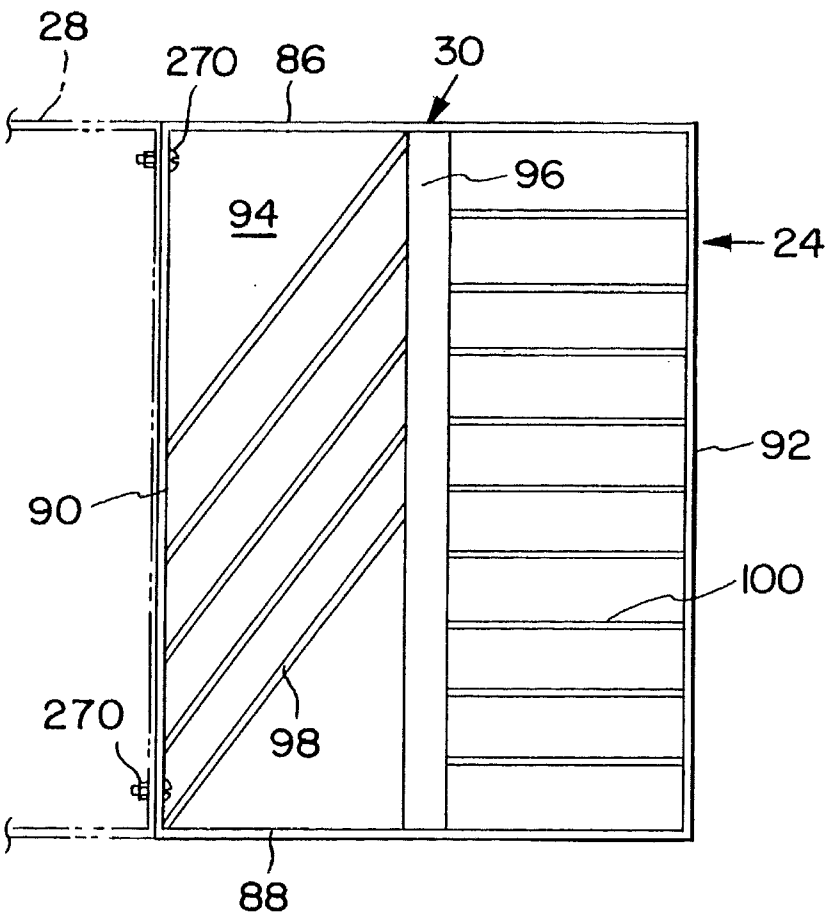
FIG. 4 is a front elevation of a second single unit width module of the modular display system of FIGS. 1 and 2.

In FIG. 4, module 30 includes top and bottom walls 86, 88, opposing side walls 90, 92, rear wall 94 and vertical panel 96. Vertical panel 96 is approximately midway between side walls 90, 92 and is spaced therefrom by inclined dividers 98 and horizontal dividers 100, respectively. Dividers 98, 100 are sized to accommodate larger dimensioned product than the dividers 74, 78 of module 26. Panel 96 is shaped to receive identifying indicia in the form of representative product (not shown) similar to product 82 for module 26 of FIG. 3. Inclined dividers 98 are positioned to store relatively wide product in a vertical column in a shingled orientation.

Figure 5:
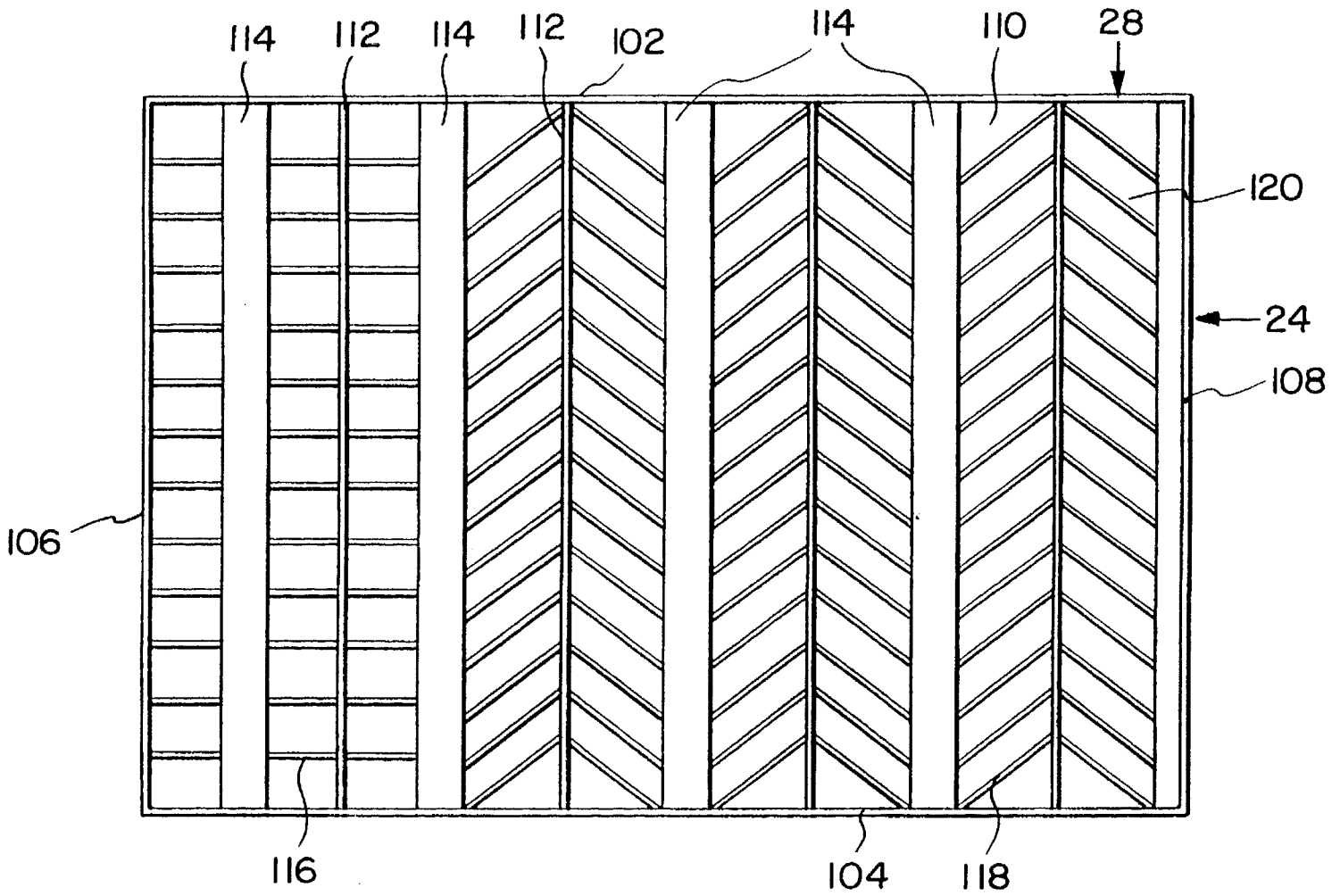
FIG. 5 is a front elevation of a first double unit width module and Incorporated into the display system of FIGS. 1 and 2.

As shown in FIG. 5, module 28 includes top and bottom walls 102, 104 which are 2 length units in width (in contrast to modules 26, 30 which are 1 unit wide each), side walls 106, 108 and rear wall 110. Vertical dividers 112 are interspersed between vertical panels 114 across the face of the module 28. Horizontal dividers 116 are substantially level in orientation and horizontal dividers 118 are inclined to hold stacks of relatively wide product. The panels 114 are shaped to hold identifying indicia of the content of the volumes 120 formed by the horizontal and vertical dividers 116, 118, 112, 114 as for module 26 of FIG. 3.

Figure 6:
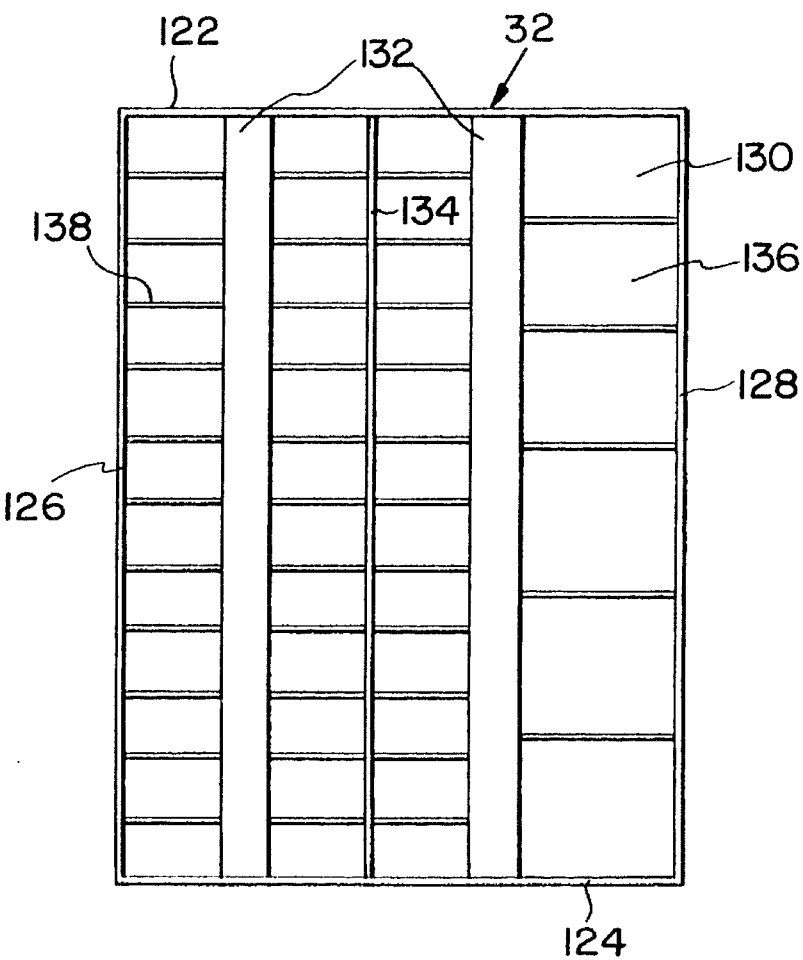
FIG. 6 is a front elevation of a third single unit width module of the modular display system of FIGS. 1 and 2.

As shown in FIG. 6, module 32 includes top and bottom walls, 122, 124 separated by opposing side walls 126, 128 and rear wall 130. Module 32 is 1 length unit in width and includes vertical panels 132 and a vertical divider 134. Interior volumes 136 are formed by horizontal dividers 138. Panels 132 are shaped to receive identifying indicia of the contents of the volumes 136, as for module 26 of FIG. 3.

Figure 7:
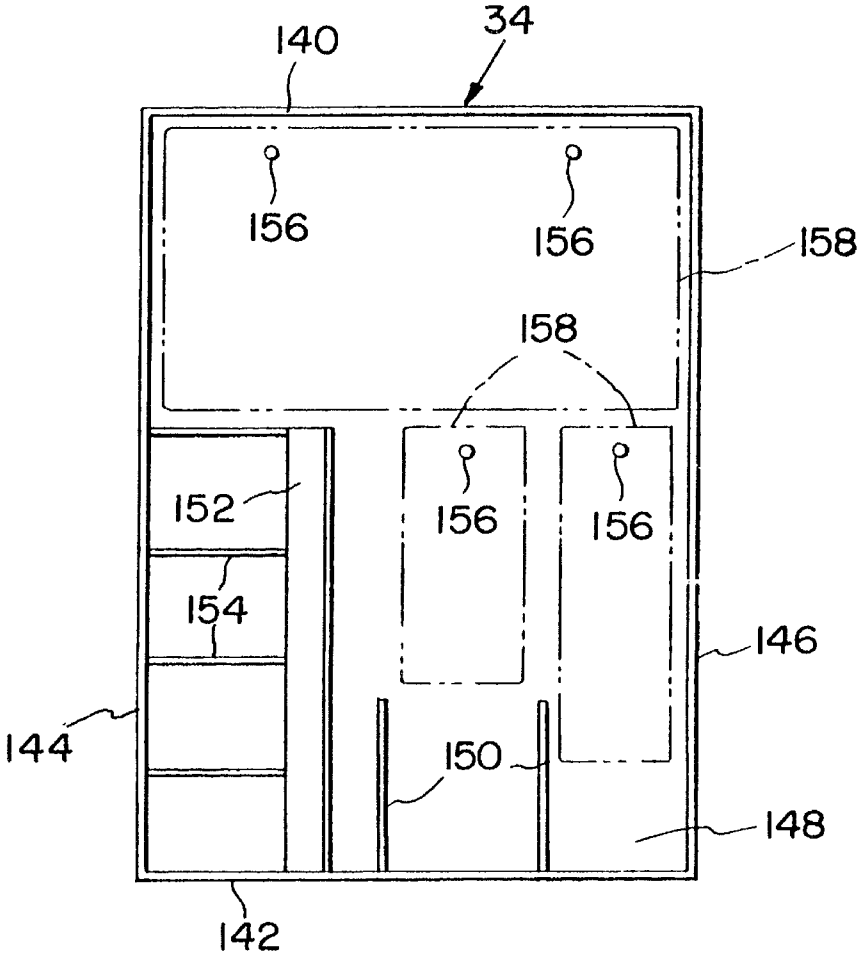
FIG. 7 is a front elevation of a fourth single unit width module of the modular display system of FIGS. 1 and 2.

FIG. 7 shows module 34 and includes top and bottom walls 140, 142, side walls 144, 146 and rear wall 148. Partial vertical dividers 150 extend upwardly from the bottom wall 142 and a partial vertical panel 152 extends approximately midway from bottom wall 142 and supports horizontal dividers 154. Rear wall 148 is preferably perforated (not shown) to receive and support mounting rods 156 to hold packaged product 158 (shown in phantom). Module 34 is one length unit in width. It is within the scope of the invention to vary the relative sizes of the partial dividers 150 and partial vertical panel 152 to accommodate a variety of different sized packages 158.

Figure 8:
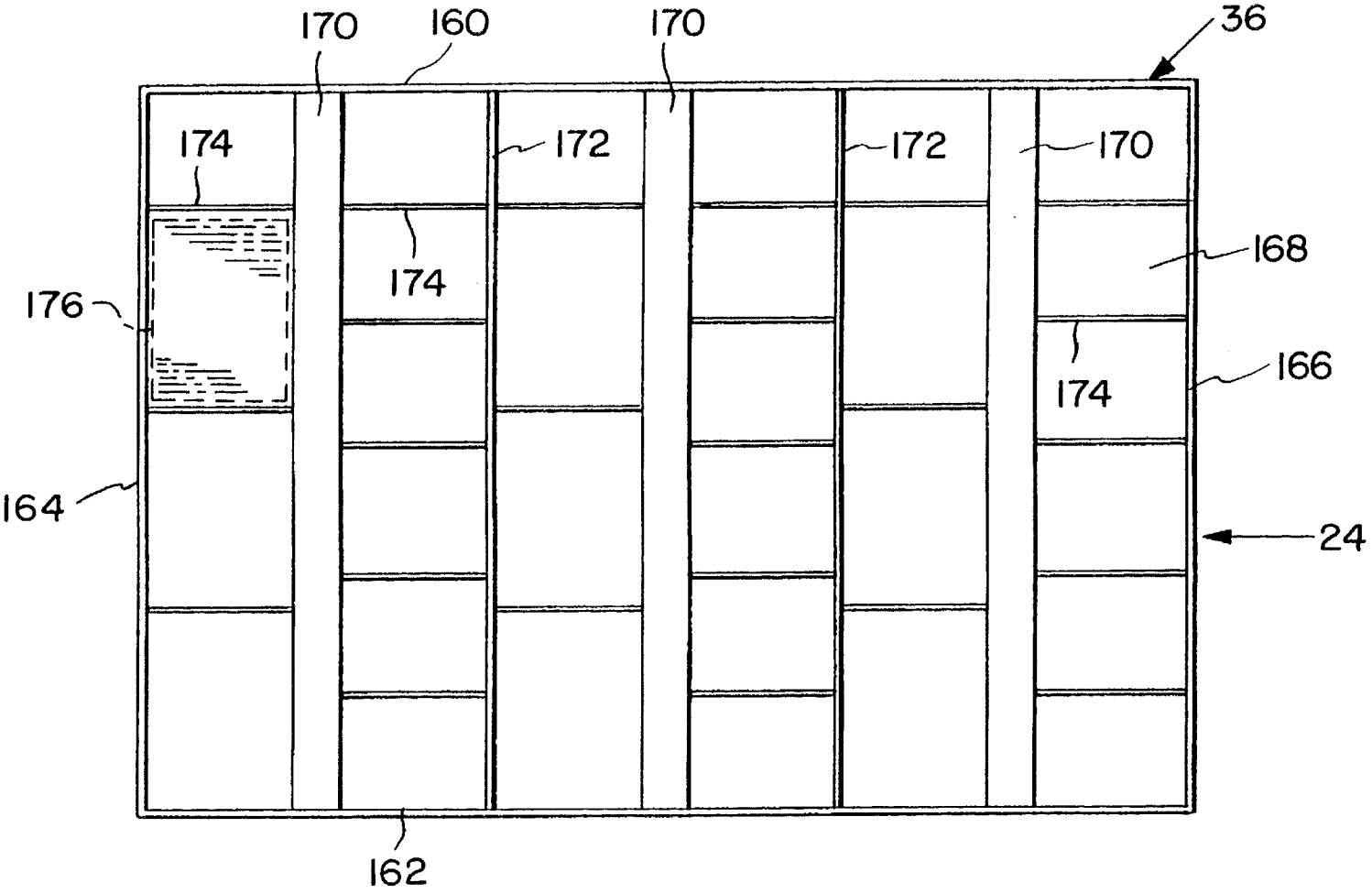
FIG. 8 is a front elevation of a second double unit width module of the modular display system of FIGS. 1 and 2.

As shown in FIG. 8, module 40 includes top and bottom walls 160, 162 which are 2 length units long, so that the module has a width equal to twice of modules 32, 34, for example. Walls 160, 162 are separated by side walls 164, 166 and rear wall 168. Vertically extending divider panels 170, extend between walls 160, 162, as to vertical dividers 172. Horizontal dividers 174 are positioned between the sidewalls 164, 166 and vertical panels 170, and between vertical panels 170 and vertical dividers 172. The spacing between the horizontal dividers 174 in a vertical dimension is greater than that for the vertical dividers of the embodiments of FIGS. 3–7 discussed above, in order to accommodate larger quantities of stacked products, such as a stack of product 176, shown in phantom.

Figure 9:
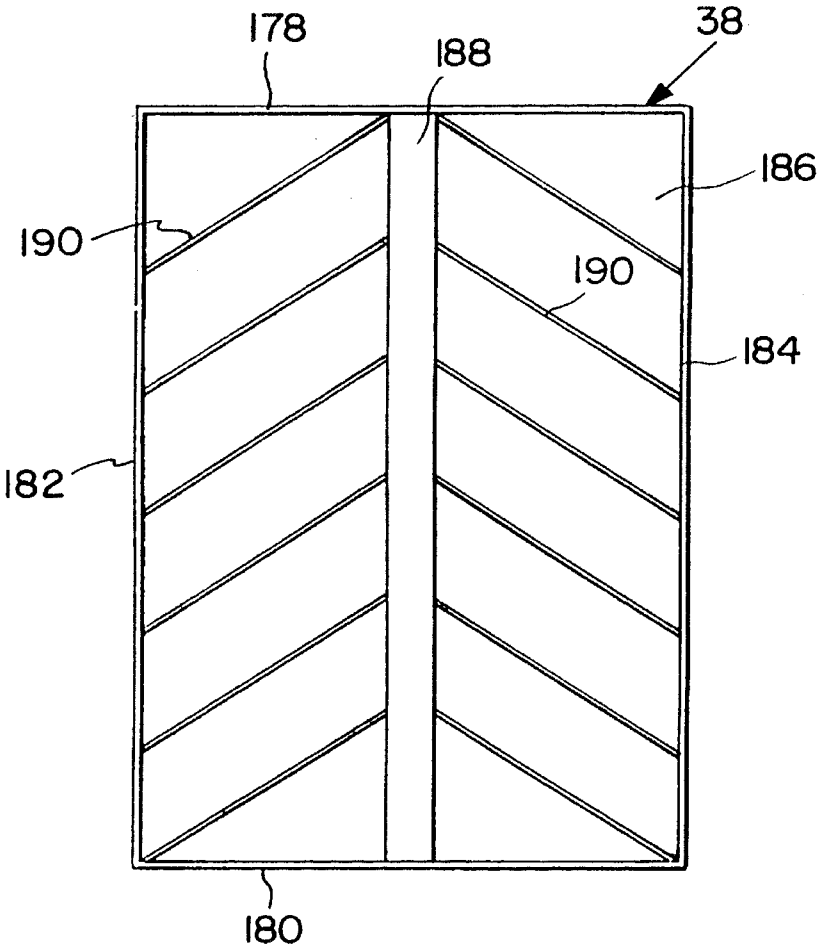
FIG. 9 is a front elevation of a fifth single unit width module of the display system of FIGS. 1 and 2.

Module 38 is shown in FIG. 9 and includes top and bottom walls 178, 180 separated by side walls. 182, 184 and rear wall 186. Vertical panel 188 divides module 38 into two sections, each having a vertical array of inclined dividers 190. Module 38 is 1 length unit wide and the inclined dividers 190 store relatively large stacks of relatively wide product in a shingled array.

Figure 10:
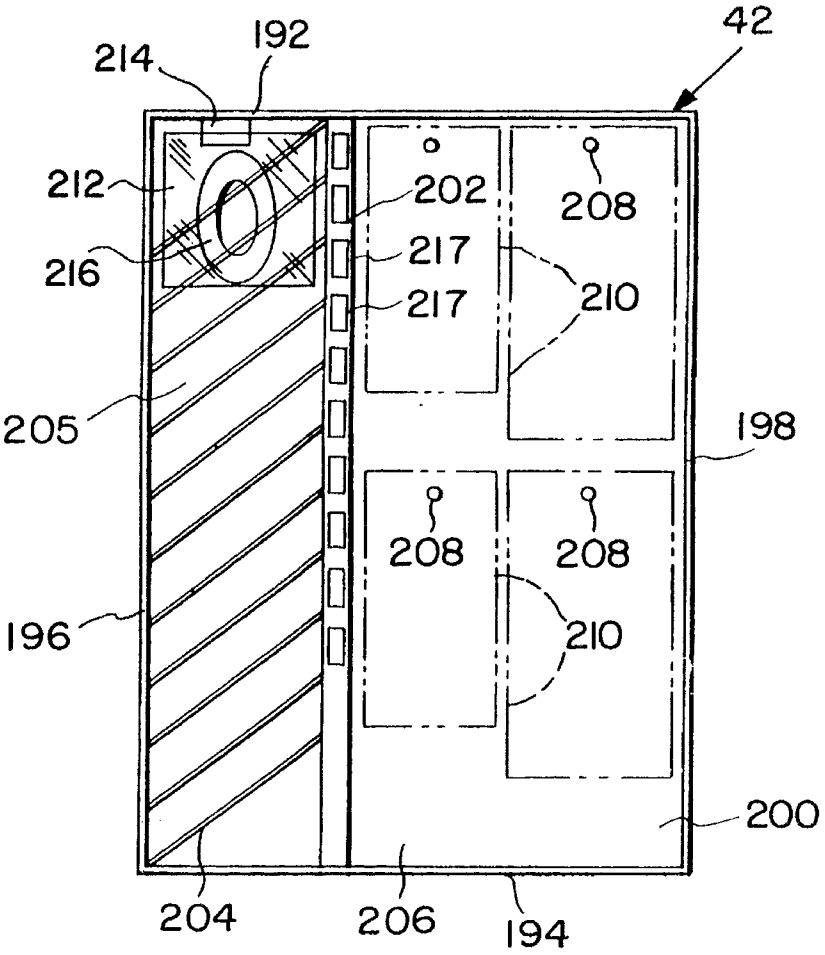
FIG. 10 is a front elevation of a sixth single unit width module of the display system of FIGS. 1 and 2.

FIG. 10 shows module 42 which includes top and bottom walls 192, 194 separated by side walls 196, 198 and rear wall 200. Vertical display panel 202 is spaced from side wall 196 and spanned by a vertical array of inclined dividers 204 forming volumes 205. A volume 206 is defined by vertical panel 202 and wall 198 and a portion of rear wall 200. At least that portion of rear wall 198 within volume 206 is preferably pegged board which supports rods 208 from which product 210 is supported.

Module 42 also includes a flip panel 212 which is made of a transparent plastic material and is attached to top wall 192 by hinge 214. Flip panel 212 supports a representative product, such as the three dimensional letter "O" 216, to indicate the size, shape and color of the products stored within the inclined vertical column of dividers 204. The product 216 may be either solid, three dimensional alphanumeric characters or may be an alphanumeric character printed on a square of plastic or metal. In the preferred embodiment, the flip panel 212 is used to display a representative product, and the divider 202 supports alphanumeric indicia 217 which indicate which specific letter or number is stored in a stack in a particular volume. Such a combination of flip panels 212 and incicia (such as 82 in FIG.

Figure 11:
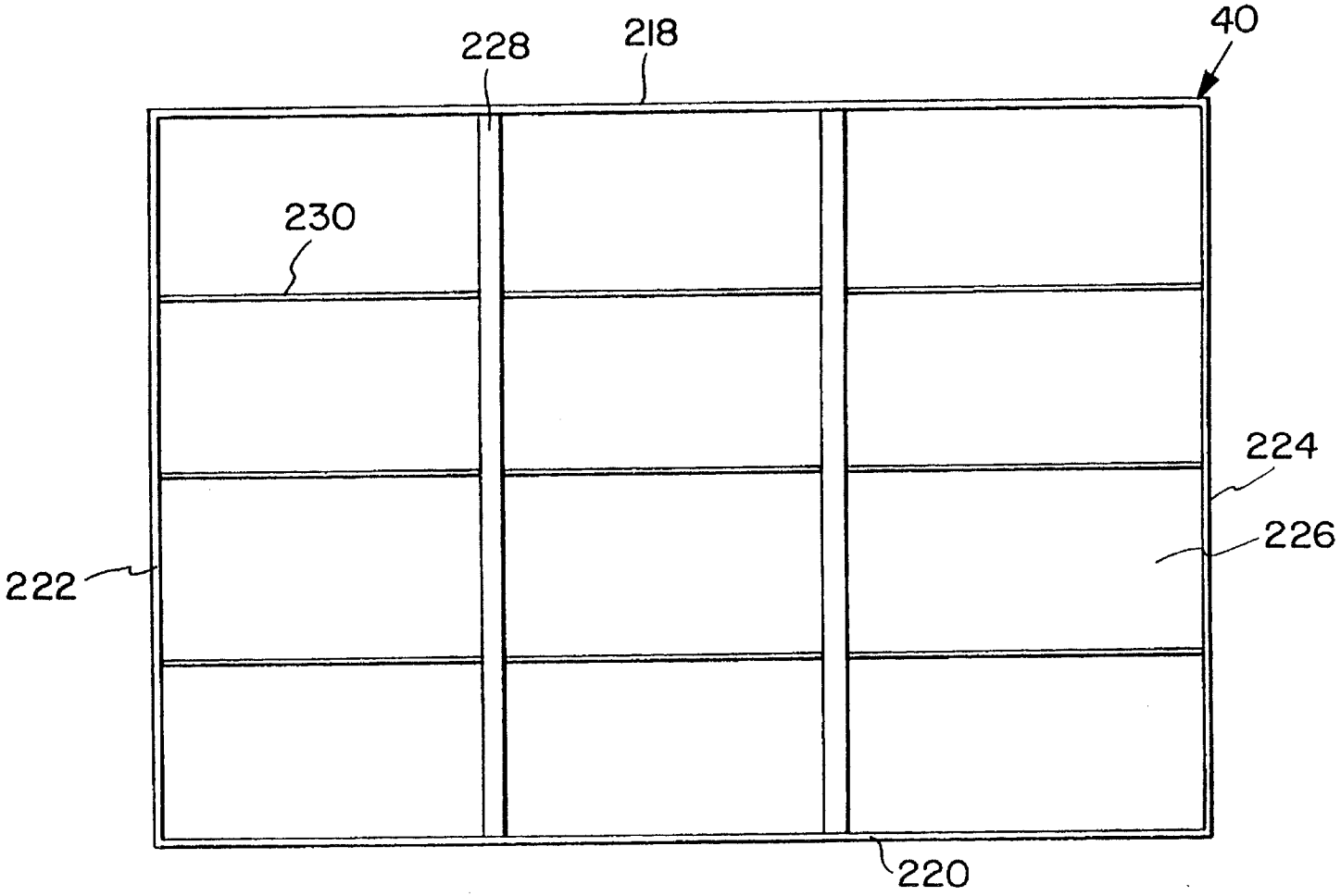
FIG. 11 is a front elevation of a third double unit width module of the display system of FIGS. 1 and 2.

As shown in FIG. 11, module 40 includes top and bottom walls 218, 220 separated by side walls 222, 224 and rear wall 226. Vertical panels 228 divide the interior volume of module 40 and are spanned by horizontal dividers 230. The flip panel 212 would be used in addition to label 92 (see FIG. 3) applied to panels 228 to indicate stacks of different alphanumeric characters. Module 40 is two length units wide and is shaped to receive, store and display relatively wide articles.

Figure 12:
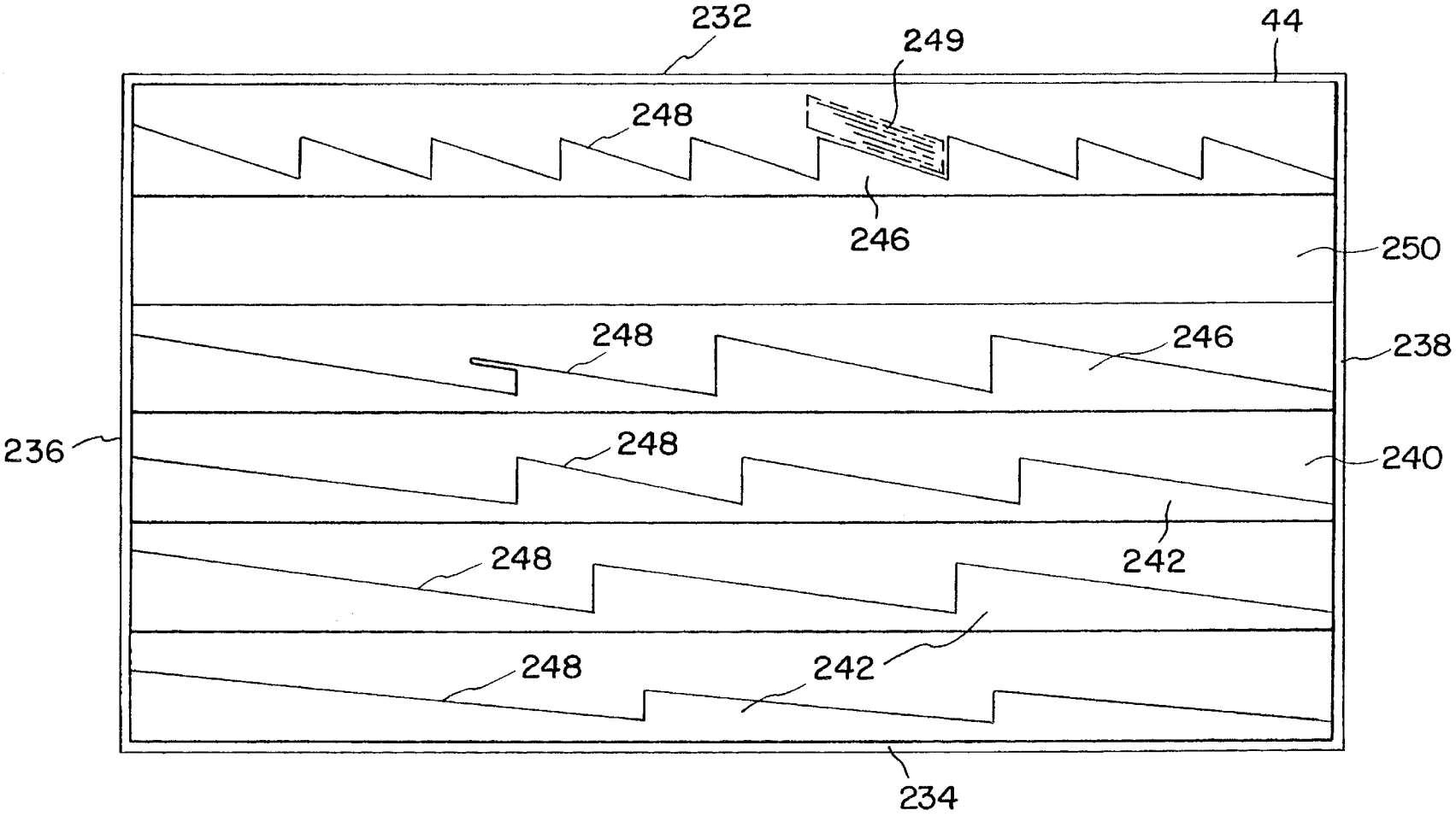
FIG. 12 is a front elevation of a four unit width module of the display system of FIGS. 1 and 2.

As shown in FIG. 12, module 44 includes top and bottom walls 232, 234, side walls 236, 238 and rear wall 240. Horizontal dividers 242, 244, 246 are shaped such that their upper surfaces 248 are saw-toothed in shape and sized to receive stacks of 249 the largest sheet type articles for storage and display in shingled fashion. Panel 250 extends the width of the module 44 and is used to display identifying indicia, as in module 26 of FIG. 3. Module 44 is four length units wide, and as shown in FIGS. 1 and 2, is typically positioned at the bottom of the system 20.

Figure 13:
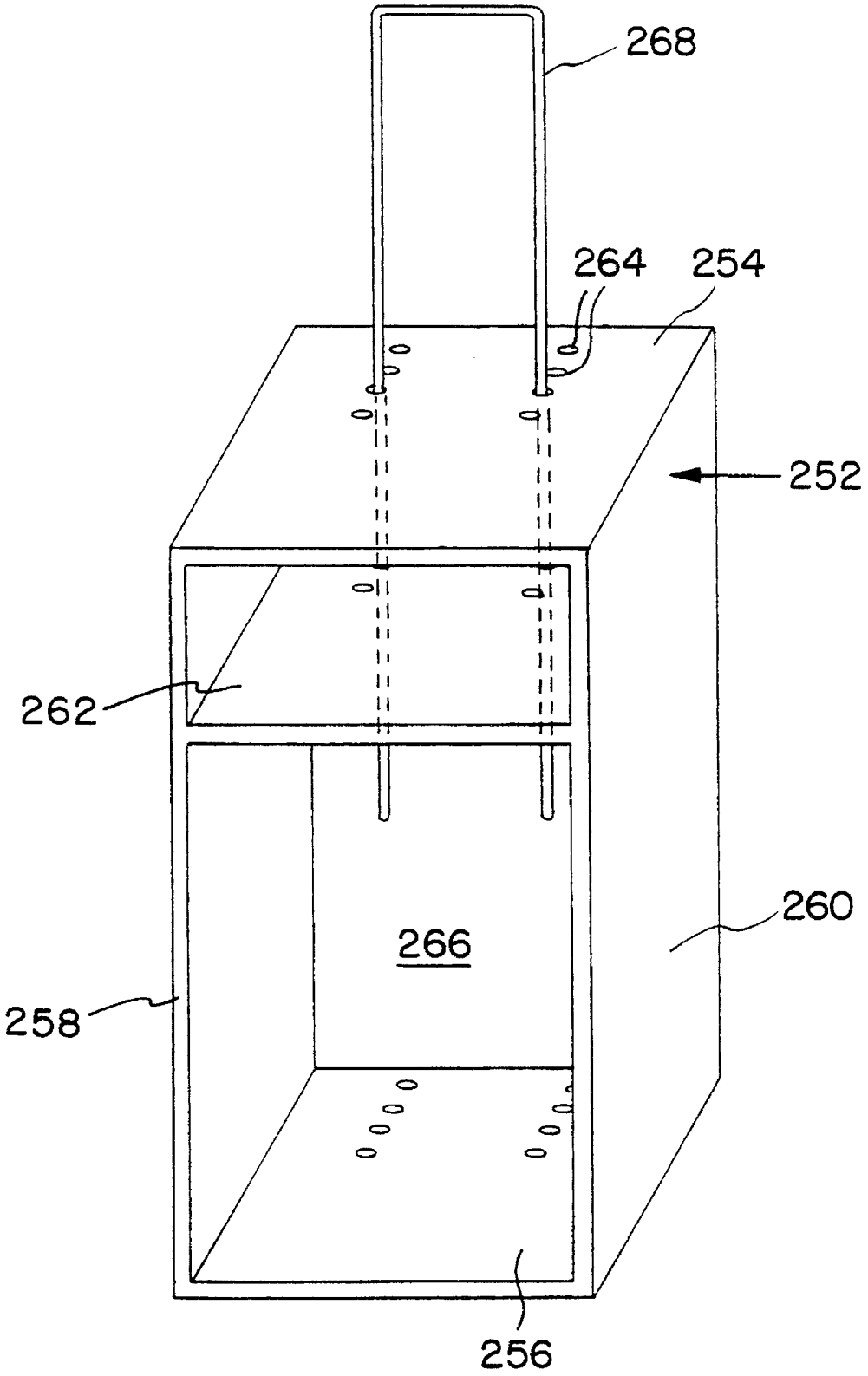
FIG. 13 is a perspective view of a typical module of the display system of FIGS. 1 and 2, showing a module depth adjustment bracket.

FIG. 13 shows a typical module 252 of the preferred embodiment which includes top and bottom walls 254, 256, side walls 258, 260 and horizontal divider 262. Walls 254, 256 and divider 262 are perforated with pairs of holes 264 which are spaced from the rear wall 266 of the module. The holes 264 are vertically aligned and sized to receive a U-shaped pin 268. The pin 268 acts as an adjustable rear wall for the module 252 so that the module can accommodate sheet-like product of varying heights (stored depth-wise in the module 252), which are arranged in a vertical stack.

As shown in FIG. 4, the modules may be interconnected by a variety of mechanisms, such as nut and bolt combinations 270, which extend through holes (not shown) formed in the top, bottom and side walls of the modules 24.

In summary, the system 20 of the present invention comprises a plurality of open-faced, modular units which preferably are made of plastic and can be interconnected by a variety of mechanisms, such as nut and bolt combinations. Each of the modules includes vertical and horizontal dividers to form a plurality of discrete volumes for receiving and storing stacks of sheet-like products, such as alphanumeric characters for signs, as well as signs themselves (see FIG. 12). The dividers are shaped to support representative units of product, which indicate the contents of the volumes. When larger units of product are stored, representative units of product are displayed on panels attached to the module by hinges.

The modules preferably are provided in 1, 2 and 4 length unit widths, with uniform depth and height dimensions. For example, a one length unit module would have a width of 12 inches and a height of 16 inches. Accordingly, the present invention provides a modular system for storage and display of stacks of alphanumeric product, and which also supports graphics associated with the products.

While the forms of apparatus herein described constitute preferred embodiments of the invention, it is to be understood that the present invention is not limited to these precise forms of apparatus and that changes may be made therein without departing from the scope of the invention.

What is claimed is:

1. A modular display system for storing and displaying a variety of substantially flat products comprising:

a first display module having a width of a single unit, an open front, a first plurality of internal divider elements separating an internal volume of said first module into a first plurality of volumes, each shaped to receive a predetermined amount of a particular product;

a second display module having a width of two of said units, a second plurality of internal divider elements separating an internal volume of said second module into a second plurality of volumes, each shaped to receive a predetermined amount of a particular product;

strip means extending along said first and second modules for receiving indicia indicative of contents of said first and second volumes; and means for interconnecting said first and second modules, whereby a plurality of said first and second modules can be attached to each other and arranged in a plurality of configurations to form display units of different sizes, shapes and footprints to fit a variety of product mix and space requirements.

2. The display system of claim 1 further comprising a third display module having a width of four of said units, an open front, a third plurality of internal divider elements separating an internal volume of said third module into a third plurality of volumes; means for interconnecting said third module with said first and second modules, whereby a plurality of said first and second modules can be attached to said third module and arranged in a plurality of configurations to form display units of different sizes, shapes and footprints to fit a variety of product mix and space requirements.

3. The display system of claim 2 wherein said third divider elements are shaped to divide said third module into horizontal volumes, and are sawtooth shaped on upper surfaces thereof such that display items are stored and displayed in shingled fashion.

4. The display system of claim 3 wherein said third divider elements are shaped to receive indicia indicative of contents supported by said third divider elements.

5. The display system of claim 3 further comprising a fourth display module having a width of one of said units, an open front, a fourth plurality of internal divider elements separating an internal volume of said fourth module into a fourth plurality of volumes, one of said fourth volumes being shaped to receive packaged product in horizontal stacks, and a rear wall shaped to receive horizontally-extending rods to support said packaged product.

6. The display system of claim 2 wherein said first divider elements are sloped with respect to the horizontal and are aligned vertically, whereby stacks of different product can be stored and displayed in vertical shingled fashion.

7. The display system of claim 1 further comprising flip panel means, pivotally connected to said modules, for receiving and displaying a sample of said product.

8. The display system of claim 7 wherein said flip panel means is substantially transparent.

9. The display system of claim 8 wherein said flip panel means overlies at least one of said plurality of volumes.

10. The display system of claim 9 wherein said flip panel means displays a representative one of said product, and said indicia are associated with each of said plurality of volumes in one-to-one correspondence, thereby indicating specific contents of each of said plurality of volumes.

* * * * *